US010182299B1

(12) United States Patent
Ma et al.

(10) Patent No.: US 10,182,299 B1
(45) Date of Patent: Jan. 15, 2019

(54) HEARING DEVICE AND METHOD WITH FLEXIBLE CONTROL OF BEAMFORMING

(71) Applicant: GN HEARING A/S, Ballerup (DK)

(72) Inventors: Changxue Ma, Barrington, IL (US); Rob De Vries, Tilburg (NL); Andrew Dittberner, Andover, MN (US)

(73) Assignee: GN Hearing A/S, Ballerup (DK)

( * ) Notice: Subject to any disclaimer, the term of this patent is extended or adjusted under 35 U.S.C. 154(b) by 0 days.

(21) Appl. No.: 15/832,692

(22) Filed: Dec. 5, 2017

(51) Int. Cl.
*H04R 25/00* (2006.01)

(52) U.S. Cl.
CPC ..... *H04R 25/407* (2013.01); *H04R 25/405* (2013.01); *H04R 25/552* (2013.01); *H04R 25/554* (2013.01); *H04R 2225/51* (2013.01)

(58) Field of Classification Search
CPC .. H04R 25/552; H04R 25/554; H04R 25/407; H04R 2225/51; H04R 25/405
USPC ..... 381/23.1
See application file for complete search history.

(56) References Cited

U.S. PATENT DOCUMENTS

2018/0098160 A1* 4/2018 Jensen ..... H04R 25/405

* cited by examiner

*Primary Examiner* — Paul S Kim
(74) *Attorney, Agent, or Firm* — Vista IP Law Group, LLP

(57) ABSTRACT

A hearing device of a binaural hearing system is disclosed, the binaural hearing system comprising the hearing device and a contralateral hearing device. The hearing device comprises: a transceiver module for communication with the contralateral hearing device of the binaural system, the transceiver module configured for provision of a contralateral signal received from the contralateral hearing device; and a set of microphones comprising a first microphone and a second microphone for provision of a first microphone input signal and a second microphone input signal, respectively. The hearing device comprises: a beamforming module connected to the first microphone and the second microphone for processing the first microphone input signal, the second microphone input signal and the contralateral signal, the beamforming module configured to provide a first beamformed input signal. The hearing device comprises a beamforming controller connected to the beamforming module and the transceiver module.

15 Claims, 2 Drawing Sheets

HEARING DEVICE AND METHOD WITH FLEXIBLE CONTROL OF BEAMFORMING

FIELD

The present disclosure relates to a hearing device of a binaural hearing system, a method of controlling beamforming of a hearing device.

BACKGROUND

Hearing device manufacturers face many challenges in providing hearing devices which imitate normal hearing and the human brain's perception, to provide a satisfying hearing experience for hearing device users.

It remains challenging to develop hearing devices that work with the auditory system and the acoustic environment.

SUMMARY

Accordingly, there is a need for devices and methods that overcome or address the challenges presented above. It is an object of the present disclosure to provide devices and methods that enhance the acoustic experience of a hearing aid user by improving the beamforming control in the hearing device.

A hearing device of a binaural hearing system is disclosed, the binaural hearing system comprising the hearing device and a contralateral hearing device. The hearing device comprises: a transceiver module for communication with the contralateral hearing device of the binaural system, the transceiver module configured for provision of a contralateral signal received from the contralateral hearing device; and a set of microphones comprising a first microphone and a second microphone for provision of a first microphone input signal and a second microphone input signal, respectively. The hearing device comprises: a beamforming module connected to the first microphone and the second microphone for processing the first microphone input signal, the second microphone input signal and the contralateral signal, the beamforming module configured to provide a first beamformed input signal; and a processing unit for processing beamformed input signals and providing an electrical output signal based on the first beamformed input signal from the beamforming module. The hearing device comprises a receiver for converting the electrical output signal to an audio output signal; and a beamforming controller connected to the beamforming module and the transceiver module. The beamforming controller is configured to control the beamforming module to apply at least part of a first set of coefficients in the beamforming module; determine a target set of coefficients for the beamforming module; and determine a first intermediate set of coefficients based on the first set and the target set of coefficients. The beamforming controller is configured to control the beamforming module to apply at least part of the first intermediate set of coefficients in the beamforming module; and control the beamforming module to apply at least part of the target set of coefficients in the beamforming module.

Further, the present disclosure relates to a method of controlling beamforming of a hearing device. The method comprising controlling a beamforming scheme to apply at least part of a first set of coefficients to a microphone input signal and a contralateral signal; determining a target set of coefficients; determining a first intermediate set of coefficients based on the first set and the target set of coefficients; controlling the beamforming scheme to apply at least part of the first intermediate set of coefficients to the microphone input signal and the contralateral signal; and controlling the beamforming scheme to apply at least part of the target set of coefficients to the microphone input signal and the contralateral signal.

It is an advantage of the present disclosure that the hearing device disclosed herein benefits from a flexible and smooth, yet perceptible, steering or control of the beamforming operation. The control of the beamforming according to this disclosure is just sufficiently perceptible for the user to perceive a change in the beamforming but still smoothly performed for the comfort of the user of the hearing device.

A hearing device of a binaural hearing system comprising the hearing device and a contralateral hearing device, includes: a transceiver module for communication with the contralateral hearing device of the binaural system, the transceiver module configured for provision of a contralateral signal received from the contralateral hearing device; a set of microphones comprising a first microphone and a second microphone for provision of a first microphone input signal and a second microphone input signal, respectively; a beamforming module connected to the first microphone and the second microphone for processing the first microphone input signal, the second microphone input signal, and the contralateral signal, wherein the beamforming module is configured to provide a first beamformed input signal; a processing unit configured to provide an electrical output signal based on the first beamformed input signal; a receiver configured to provide an audio output signal based on the electrical output signal; and a beamforming controller connected to the beamforming module and the transceiver module; wherein the beamforming controller is configured to: control the beamforming module to apply at least a part of a first set of coefficients; determine a target set of coefficients for the beamforming module; determine a first intermediate set of coefficients based on one or more coefficients in the first set of coefficients, and based on one or more coefficients in the target set of coefficients; control the beamforming module to apply at least a part of the first intermediate set of coefficients; and control the beamforming module to apply at least a part of the target set of coefficients.

Optionally, the first intermediate set of coefficients is normalized.

Optionally, the beamforming controller is configured to determine whether the target set of coefficient satisfies a flexible control criterion; and wherein the beamforming controller is configured to determine the first intermediate set of coefficients, and to control the beamforming module to apply the at least a part of the first intermediate set of coefficients if the target set of coefficient satisfies the flexible control criterion.

Optionally, the flexible control criterion is based on a perception parameter.

Optionally, the perception parameter is based on one or more user preferences.

Optionally, the flexible control criterion is based on a step parameter.

Optionally, the step parameter is selected from a range.

Optionally, the beamforming controller is configured to determine the target set of coefficients based on an acoustic environment parameter.

Optionally, the beamforming controller is configured to determine the target set of coefficients for the beamforming module by optimizing a cost function of the first set of coefficients based on a statistical expectation.

Optionally, the beamforming controller is configured to determine a second intermediate set of coefficients; and wherein the beamforming controller is configured to control the beamforming module to apply at least a part of the first and second intermediate sets of coefficients before applying the target set of coefficients.

A method of controlling beamforming of a hearing device, includes: controlling a beamforming scheme to apply at least a part of a first set of coefficients to a microphone input signal and to a contralateral signal; determining a target set of coefficients; determining a first intermediate set of coefficients based on one or more coefficients in the first set of coefficients and based on one or more coefficients in the target set of coefficients; controlling the beamforming scheme to apply at least a part of the first intermediate set of coefficients to the microphone input signal and to the contralateral signal; and controlling the beamforming scheme to apply at least a part of the target set of coefficients to the microphone input signal and to the contralateral signal.

Optionally, the method further includes: determining whether the target set of coefficients satisfies a flexible control criterion; wherein the act of determining the first intermediate set of coefficients, and the act of controlling the beamforming module to apply the at least a part of the first intermediate set of coefficients, are performed if the target set of coefficients satisfies the flexible control criterion.

Optionally, the act of determining the target set of coefficients is performed based on an acoustic environment parameter.

Optionally, the act of determining the target set of coefficients comprises optimizing a cost function of the first set of coefficients based on a statistical expectation.

Optionally, the method further includes: determining a second intermediate set of coefficients; and controlling the beamforming module to apply at least a part of the first and second intermediate sets of coefficients before applying the target set of coefficients.

Other advantageous and/or features will be described in the detailed description.

BRIEF DESCRIPTION OF THE DRAWINGS

The above and other features and advantages will become readily apparent to those skilled in the art by the following detailed description of exemplary embodiments thereof with reference to the attached drawings, in which.

DETAILED DESCRIPTION

Figure 1:
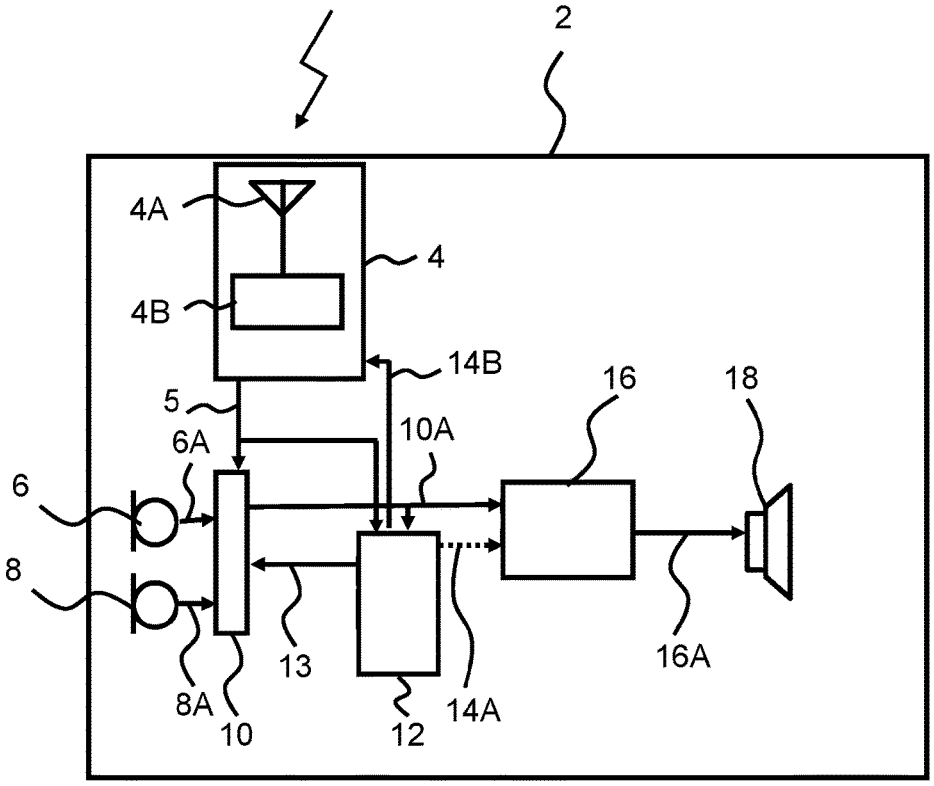
FIG. 1 schematically illustrates an exemplary hearing device.

Various exemplary embodiments and details are described hereinafter, with reference to the figures when relevant. It should be noted that the figures may or may not be drawn to scale and that elements of similar structures or functions are represented by like reference numerals throughout the figures. It should also be noted that the figures are only intended to facilitate the description of the embodiments. They are not intended as an exhaustive description of the invention or as a limitation on the scope of the invention. In addition, an illustrated embodiment needs not have all the aspects or advantages shown. An aspect or an advantage described in conjunction with a particular embodiment is not necessarily limited to that embodiment and can be practiced in any other embodiments even if not so illustrated, or if not so explicitly described.

The present disclosure may be seen as related to ear-to-ear audio streaming. The inventors have realized that utilizing the signals from both hearing devices in a binaural hearing system may support enhancing the speech intelligibility by beamforming in noisy environments and cocktail party scenarios.

It is noted that attempts to reducing noise by beamforming do not consider the mechanisms of the human auditory system and needs for social interaction in a conversation. For example, an optimal high directivity beamforming could be more than necessarily needed to overly suppress the off-axis talkers and cause a tunnel hearing problem. The present disclosure proposes to exploit the binaural auditory steering strategy of the auditory system, the ear-to-ear audio streaming for beamforming and off-axis source steering towards the monitor ear, which results in a. Better speech intelligibility due to an adequate directivity index for listening environment, and/or b. Better awareness of all sounds in the environment (situational awareness) by providing to the off-axis sources due to monitor ear for maintaining multiple streams for selective listening (e.g. better awareness to the off-axis sources due to monitor ear for maintaining multiple streams).

A hearing device is disclosed herein. The hearing device may be a hearing aid, wherein the processing unit is configured to compensate for a hearing loss of a user.

The hearing device may be of the behind-the-ear (BTE) type, in-the-ear (ITE) type, in-the-canal (ITC) type, receiver-in-canal (RIC) type or receiver-in-the-ear (RITE) type. The hearing device may be a binaural hearing aid. The hearing device may comprise a first earpiece and a second earpiece, wherein the first earpiece and/or the second earpiece is an earpiece as disclosed herein.

The hearing device may be part of a binaural hearing system. The binaural hearing system comprises the hearing device and a contralateral hearing device.

The hearing device comprises a transceiver module for communication with the contralateral hearing device of the binaural system. The transceiver module is configured for provision of a contralateral signal received from the contralateral hearing device. In other words, the transceiver module is configured to provide a contralateral signal received from the contralateral hearing device, such as via a wired connection or a wireless connection.

The hearing device comprises a set of microphones comprising a first microphone and a second microphone for provision of a first microphone input signal and a second microphone input signal, respectively. The set of microphones may comprise N microphones for provision of N microphone input signals, wherein N is an integer in the range from 1 to 50, such as 1 to 20, such as 1 to 10. In one or more exemplary hearing devices, the number N of microphones is two, three, four, five or more. The set of microphones may comprise a third microphone for provision of a third microphone input signal.

The hearing device comprises a beamforming module connected to the first microphone and the second microphone for processing the first microphone input signal, the second microphone input signal and the contralateral signal. The beamforming module is configured to provide a first beamformed input signal.

The hearing device comprises a processing unit for processing beamformed input signals and providing an electrical output signal based on the first beamformed input signal from the beamforming module. The hearing device comprises a processing unit for processing input signals, such as beamformed input signal(s). Input terminal(s) of the processing unit are optionally connected to respective output terminals of the beamforming controller and/or the beamforming module. For example, a transceiver input terminal of the processing unit may be connected to a transceiver output terminal of the pre-processing unit. One or more microphone input terminals of the processing unit may be connected to respective one or more microphone output terminals of the pre-processing unit.

The hearing device comprises a receiver for converting the electrical output signal to an audio output signal.

The hearing device comprises a beamforming controller connected to the beamforming module and the transceiver module. The beamforming controller is configured to control the beamforming module to apply at least part of a first set of coefficients in the beamforming module. The beamforming module may be configured to apply at least part of the first set of coefficients to a microphone input signal, such as the first microphone input signal and/or the second microphone input signal. The beamforming controller is configured to transmit a control signal to the contralateral hearing device, e.g. via the transceiver, so as to enable the contralateral device to apply corresponding beamforming coefficients to contralateral signals. The corresponding beamforming coefficients may be part of the first set of coefficients. The corresponding beamforming coefficients applied to the contralateral signal may be different from the beamforming coefficients applied to the microphone input signals.

The beamforming controller may be configured to determine a target set of coefficients for the beamforming module, such as based on the contralateral signal, the first microphone input signal and/or the second microphone input signal. In one or more exemplary hearing devices, the beamforming controller is configured to determine the target set of coefficients based on an acoustic environment parameter, such as indicative of a classification of the acoustic environment. For example, the beamforming controller may be configured to initiate a shift to an intermediate set and/or a target set by receiving manually a user input e.g. via an application running on an accessory device coupled with the hearing device. For example, the beamforming controller may be configured to initiate a shift to an intermediate set and/or a target set by determining whether a criterion being met, wherein the criterion is based on one or more user preferences and/or environmental noise level.

In one or more exemplary hearing device, the beamforming controller is configured to determine the target set of coefficients for the beamforming module by optimizing a cost function of the first set of coefficients based on a statistical expectation. Stated differently, the beamforming controller is configured to determine the target set of coefficients for the beamforming module by solving a minimization problem.

In one or more exemplary hearing devices, the first intermediate set of coefficients is normalized. For example, the sum of all coefficients of the first intermediate set of coefficients is 1, such as $\alpha+\beta=1$, where $[\alpha|\beta]$ denotes the first intermediate set of coefficients.

The beamforming controller may be configured to optimize the cost function optionally under one or more constraints, such as the normalization of the first set coefficients.

It may be envisaged that the target set of coefficients comprises target primary set of coefficients, denoted $\alpha$, related to the first beamformed input signal (and applied to the microphone input signals) and/or target secondary set of coefficients, denoted $\beta$, for the contralateral hearing device to beamform contralateral signals.

In other words, to determine the target set of coefficients $(\alpha, \beta)$ may comprise to solve a minimization problem under the constraint $\alpha+\beta=1$, e.g. given by:

$$s_i = \underset{\alpha,\beta}{\mathrm{ARG\,min}}(SNR(l_i), SNR(r_i), SNR(\alpha l_i + \beta r_i), \tag{1}$$

where $l_i$ is the first beamformed input signal, $r_i$ is the contralateral signal, in the ith subband, and $\alpha$ is the target primary set of coefficients. It is assumed that the target sound source is located on the zero-direction axis. The equation above can be simplified as:

$$s_i = \underset{\alpha,\beta}{\mathrm{ARG\,min}}(\mathrm{rms}(l_i), \mathrm{rms}(r_i), \mathrm{rms}(\alpha l_i + \beta r_i), \tag{2}$$

where rms represents the root mean square value of the signal (e.g. of the signal amplitude, or phase, or any other related metric representative of the signal). It is equivalent to solving the $\alpha$ and $\beta$ in the following cost functions $C(\alpha,\beta)$:

$$\mathrm{argmin}\ \{E[(\alpha l_i+\beta r_i)\cdot(\alpha l_i+\beta r_1)]\} \tag{3}$$

and under the constraints $\alpha+\beta=1$ and E is statistical expectation, where $\alpha$ is the first bandpass coefficient and $\beta$ is the contralateral bandpass coefficient.

In one or more exemplary hearing devices, to solve a minimization problem may comprise applying a stochastic steepest descent algorithm.

In one or more exemplary hearing devices, to solve a minimization problem may comprise applying a least mean square algorithm or a normalized least mean square algorithm.

The minimization problem may be obtained adaptively, e.g. by:

$$C(\alpha,\beta)=\{E\{(\alpha l_i+\beta r_i)\cdot(\alpha l_i+\beta r_i)\}+\lambda(\alpha+\beta-1) \tag{4}$$

The minimization problem may be solved by using the stochastic steepest descent algorithm comprising:

Take Gradient $$\nabla C = \begin{pmatrix} 2\alpha E\{l\cdot l) + 2\beta E\{l\cdot r\} + \lambda \\ 2\beta E\{r\cdot r) + 2\alpha E\{l\cdot r\} + \lambda \end{pmatrix} = 2\begin{Bmatrix} E\{v\cdot l\} + \lambda \\ +E\{v\cdot r\} + \lambda \end{Bmatrix}$$

Solve Lagrange $\lambda=-E\{v\cdot l\}-E\{v\cdot r\}$ and $v=\alpha l+\beta r$ $$\nabla C = \begin{Bmatrix} E\{v\cdot l\} - E\{v\cdot r\} \\ E\{v\cdot r\} - E\{v\cdot l\} \end{Bmatrix}$$

Solution is $$\begin{pmatrix} \alpha_{n+1} \\ \beta_{n+1} \end{pmatrix} = \begin{pmatrix} \alpha_n \\ \beta_n \end{pmatrix} - \mu\cdot\begin{Bmatrix} E\{v\cdot l\} - E\{v\cdot r\} \\ E\{v\cdot r\} - E\{v\cdot l\} \end{Bmatrix}$$

$\mu$ is step size

The minimization problem may be solved by using LMS algorithm (least mean square):

$$\begin{pmatrix}\alpha_{n+1}\\ \beta_{n+1}\end{pmatrix}=\begin{pmatrix}\alpha_n\\ \beta_n\end{pmatrix}-\mu\cdot\begin{Bmatrix}\{v\cdot l\}-\{v\cdot r\}\\ \{v\cdot r\}-\{v\cdot l\}\end{Bmatrix} \tag{5}$$

The minimization problem may be solved by using NLMS algorithm (normalized least mean square):

$$\begin{pmatrix}a_{n+1}\\ \beta_{n+1}\end{pmatrix}=\begin{pmatrix}\alpha_n\\ \beta_n\end{pmatrix}-\mu\cdot\begin{Bmatrix}\{v\cdot l\}-\{v\cdot r\}\\ \{v\cdot r\}-\{v\cdot l\}\end{Bmatrix}\Big/\{v\cdot v\} \tag{6}$$

or $$\begin{pmatrix}a_{n+1}\\ \beta_{n+1}\end{pmatrix}=\begin{pmatrix}\alpha_n\\ \beta_n\end{pmatrix}-\mu\cdot\begin{Bmatrix}\{v\cdot(l-r)\}\\ \{v\cdot(r-l)\}\end{Bmatrix}\Big/\{v\cdot v\} \tag{7}$$

For all three algorithms, the update is done when $v\cdot v>0$. The implemented solution is as follows:

$$\begin{pmatrix}a_{n+1}\\ \beta_{n+1}\end{pmatrix}=\begin{pmatrix}\alpha_n\\ \beta_n\end{pmatrix}-\mu\cdot\begin{Bmatrix}\{v\cdot(l_i-r_i)\}\\ \{v\cdot(r_i-l_i)\}\end{Bmatrix}, \tag{8}$$

where the output is $v=\alpha_n l_i+\beta_n r_i$ and the step size $\mu=0.001$, $\alpha_n$ is the first bandpass coefficient, and $\beta_n$ is the contralateral bandpass coefficient used in the bandpass beamformer.

For example, the size of the signal vectors $l_i$ and $r_i$ may be in a range of [20-60], e.g. 48 samples at sampling rate from 8 kHz to 33 kHz, e.g. 16 kHz. The signal vectors may be accumulative in two frames in calculation.

In one or more exemplary hearing devices, the better ear strategy (minimization problem) may, e.g. for one or more sub-bands, be expressed as:

$$s_i=\text{argmin}(rms(l_i),rms(r_i),rms(v)) \tag{9a},$$

e.g. the beamform controller may be configured to determine the target set of coefficients by solving this minimization problem. When the adaptation process converges, the solution is the beamforming result (target set comprising a target primary set and a target secondary set (e.g. for the contralateral)). When adaptation process is started from equal weights, ($\alpha_0=\beta_0=0.5$), the better ear listening strategy could select the signal from minimum RMS of the three signals. Given Equation (9a) for the hearing device, at the contralateral hearing device, if any, the better ear strategy (minimization problem) may, e.g. for one or more sub-bands, be expressed as:

$$s_i=\text{argmax}(rms(l_i),rms(r_i),rms(v)) \tag{9b},$$

In one or more exemplary hearing device, the beamforming controller is configured to determine a number of intermediate sets of coefficients. For example, the beamforming controller 12 is configured to determine the number N of intermediate sets in the following manner:

$$N=\text{mod}\left(\frac{D}{\mu}\right)-1 \tag{10}$$

wherein D denotes the distance from current set to the target set and $\mu$ denotes the step size.

The beamforming controller may be configured to determine coefficients for each intermediate set of coefficients and sequentially control the beamforming module to apply at least part of the intermediate sets of coefficients before applying the target set of coefficients. The beamforming controller may be configured to determine coefficients for each intermediate set of coefficients based on the step parameter.

The beamforming controller may be configured to determine a first intermediate set of coefficients based on the first set and the target set of coefficients. The beamforming controller may be configured to control the beamforming module to apply at least part of the first intermediate set of coefficients in the beamforming module. The beamforming controlled is configured to control the beamforming module to apply at least part of the target set of coefficients in the beamforming module.

In one or more exemplary hearing devices, the hearing device may comprise an antenna for converting one or more wireless input signals, e.g. a first wireless input signal and/or a second wireless input signal, to an antenna output signal. The wireless input signal(s) may originate from the contralateral hearing device or external source(s), such as spouse microphone device(s), wireless TV audio transmitter, and/or a distributed microphone array associated with a wireless transmitter.

In one or more exemplary hearing devices, the transceiver may comprise a radio transceiver coupled to the antenna for converting the antenna output signal to a transceiver input signal.

In one or more exemplary hearing devices, the hearing device may comprise a plurality of antennas and/or an antenna may be configured to be operate in one or a plurality of antenna modes.

In one or more exemplary hearing devices, the beamforming controller is configured to determine whether the target set of coefficients satisfies a flexible control criterion. The acts of determining a first intermediate set of coefficients based on the first set and the target set of coefficients and of controlling the beamforming module to apply at least part of the first intermediate set of coefficients in the beamforming module may be performed when the target set of coefficients satisfies the flexible control criterion.

In one or more exemplary hearing devices, the flexible control criterion is based on a perception parameter. In one or more exemplary hearing devices, the perception parameter is based on one or more user preferences. For example, the perception parameter is set at the fitting stage based on the user preferences, so that the shift to intermediate and/or target set of coefficients takes place in a continuous but still perceptible manner (e.g. just sufficiently perceptible). It may be envisaged that the perception parameter is set by the fitter based on feedback from what the user expresses as slightly perceptible change. For example, the determination and/or initiation of a shift to the intermediate or target set may be triggered manually e.g. via an application running on an accessory device coupled with the hearing device. For example, the determination and/or initiation of a shift to the target set may be triggered automatically based on a criterion being met, wherein the criterion is based on one or more user preferences and/or environmental noise level.

In one or more exemplary hearing devices, the flexible control criterion is based on a step parameter. The step parameter may refer to an increment value. The step parameter may for example refer to a step size, an incremental step, or a gradual step. The step parameter may be based on the perception parameter. In one or more exemplary hearing devices, the step parameter is selected from a range. The step parameter may be selected from a range, such as between [0,1 and 0,7] based on the perception parameter.

In one or more exemplary hearing devices, the beamforming controller is configured to apply one or more constraints to the determined target set of coefficients to regularize the target set of coefficients, e.g. to satisfy different beamforming needs based on preferences of the hearing device user. For example, optimal values for the target set of coefficients could vary a lot depending on the acoustic scene. For example, the range of the target coefficients on each ear or hearing device may be constrained between [$\alpha_1$, $\alpha_2$], for example [−0.2, 1.2], [0, 1], or even [0.5, 0.5], etc. In one or more exemplary hearing devices, the beamforming controller is configured to control the set of target coefficients in one hearing device and to inform the other hearing device to use a monitor beam pattern.

In an illustrative example where the present technique is applied, the focus may be on changing the coefficients in a certain way so that the directivity index can change from optimal to suboptimal to satisfy different beamforming needs. For example, the following range is selected [−0.2, 1.2] as a constraint on coefficients. A first coefficient of the first set of coefficients is 0.0. The beamforming controller determines that a first coefficient of the target set of coefficients is 1.2. The beamforming controller determines that a first coefficient of the first intermediate set of coefficients is 0.2 based on a flexible criterion with a step size of 0.2. The beamforming controller determines that a first coefficient of the second intermediate set of coefficients is 0.4 based on a flexible criterion with a step size of 0.2. The beamforming controller determines that a first coefficient of the third intermediate set of coefficients is 0.6 based on a flexible criterion with a step size of 0.2. The beamforming controller determines that a first coefficient of the fourth intermediate set of coefficients is 0.8 based on a flexible criterion with a step size of 0.2. The beamforming controller determines that a first coefficient of the fifth intermediate set of coefficients is 1 based on a flexible criterion with a step size of 0.2. The beamforming controller provides the first, the second, the third, the fourth, the fifth intermediate set of coefficients and the target set of coefficients to the beamforming module which applies at least a part of the first, the second, the third, the fourth, the fifth intermediate set of coefficients and the target set of coefficients to the first and second microphone input signals. The beamforming controller may provide the first, the second, the third, the fourth, the fifth intermediate set of coefficients and the target set of coefficients to contralateral which applies at least a part of the first, the second, the third, the fourth, the fifth intermediate set of coefficients and the target set of coefficients to the contralateral signal.

This way, the present disclosure achieves an improved directivity index for diffuse sound field listening for focused ear, an improved ear index and an improved situational awareness to provide multiple streams for selective listening. This allows to perform an optimal choice between the directivity index and the situational awareness based on the acoustic conditions. The disclosed hearing device permits a continuum in beamforming resulting in a flexible and smooth steering. This also allows one of the hearing devices to work as an open ear while the other hearing device is set a directional mode.

The present disclosure relates to a method of controlling beamforming of a hearing device. The method comprises controlling a beamforming scheme to apply at least part of a first set of coefficients to a microphone input signal and a contralateral signal. The contralateral signal is received from a contralateral hearing device of a binaural hearing device system wherein the hearing device is included.

The method comprises determining a target set of coefficients.

The method comprises determining a first intermediate set of coefficients based on the first set and the target set of coefficients.

In one or more exemplary methods, the method comprises determining whether the target set of coefficients satisfies a flexible control criterion. The acts of determining a first intermediate set of coefficients based on the first set and the target set of coefficients and of controlling the beamforming module to apply at least part of the first intermediate set of coefficients in the beamforming module may be performed when the target set of coefficients satisfies the flexible control criterion.

In one or more exemplary methods, determining the target set of coefficients is performed based on an acoustic environment parameter.

In one or more exemplary methods, determining the target set of coefficients comprises optimizing a cost function of the first set of coefficients based on a statistical expectation.

The method comprises controlling the beamforming scheme to apply at least part of the first intermediate set of coefficients to the microphone input signal and the contralateral signal.

The method comprises controlling the beamforming scheme to apply at least part of the target set of coefficients to the microphone input signal and the contralateral signal.

In one or more exemplary methods, the method comprises determining a number of intermediate sets of coefficients, determining one or more coefficients for each intermediate set of coefficients; and sequentially controlling the beamforming module to apply at least part of the intermediate sets of coefficients before applying the target set of coefficients.

The present disclosure advantageously provides a continuum in the beamforming control. It may be seen that the present disclosure provides a continuum that is a monotonic function based on binaural metrics for speech intelligibility and situational awareness and is correlated well with the auditory demand on a given acoustic environment.

Throughout, the same reference numerals are used for identical or corresponding parts.

FIG. 1 illustrates an exemplary hearing device according to this disclosure. The hearing device 2 is configured for use in a binaural hearing system comprising the hearing device and a contralateral hearing device. The hearing device 2 (left/right) hearing device of binaural hearing system) comprises a transceiver module 4 for (e.g. wireless) communication with the contralateral (right/left) hearing device (not shown in FIG. 1) of the binaural system. The transceiver module 4 may comprises antenna 4A and a radio transceiver 4B. The transceiver module 4 is configured for provision of contralateral beamform signal 5 received from the contralateral hearing device.

The hearing device 2 comprises a set of microphones comprising a first microphone 6 and a second microphone 8 for provision of a first microphone input signal 6A and a second microphone input signal 8A, respectively. The hearing device 2 comprises a beamforming module 10 connected to the first microphone 6 and the second microphone 8 for receiving and processing the first microphone input signal 6A, the second microphone input signal 8A and the contralateral signal 5. The beamforming module 10 provides or outputs a first beamformed input signal 10A based on the first microphone input signal 6A and the second microphone input signal 8A. The beamforming module 10 provides or outputs The hearing device 2 comprises a processing unit 16 for processing beamformed input signals 10A and providing an electrical output signal 16A based on the beamformed input signal 10A, and a receiver 18 for converting the electrical output signal 16A to an audio output signal.

The hearing device 2 comprises a beamforming controller 12 connected to the beamforming module 10 and the transceiver 4.

The beamforming controller 12 is configured to control the beamforming module 10 to apply at least part of a first set of coefficients in the beamforming module 10.

The beamforming controller 12 may be configured to determine a target set of coefficients for the beamforming module 10. The beamforming controller 12 may be configured to determine a target set of coefficients based on the contralateral signal 5, the first microphone input signal 6A and/or the second microphone input signal 8A. In one or more exemplary hearing devices, the beamforming controller 12 is configured to determine the target set of coefficients based on an acoustic environment parameter. For example, the determination and/or initiation of a shift to the target set may be triggered manually e.g. via an application running on an accessory device coupled with the hearing device. For example, the determination and/or initiation of a shift to the target set may be triggered automatically based on a criterion being met, wherein the criterion is based on one or more user preferences and/or environmental noise level.

In one or more exemplary hearing device, the beamforming controller 12 is configured to determine the target set of coefficients for the beamforming module 10 by optimizing a cost function of the first set of coefficients based on a statistical expectation. The beamforming controller 12 may be configured to optimize the cost function optionally under one or more constraints, such as the normalization of the first set coefficients. The beamforming controller 12 may be configured to carry out any of the computations outlined in Equations (1) to (9).

In one or more exemplary hearing device, the beamforming controller 12 is configured to determine a number of intermediate sets of coefficients. For example, the beamforming controller 12 is configured to determine the number N of intermediate sets in Equation (10).

The beamforming controller 12 may be configured to determine coefficients for each intermediate set of coefficients and sequentially control the beamforming module 10 to apply at least part of the intermediate sets of coefficients before applying the target set of coefficients. The beamforming controller 12 may be configured to determine coefficients for each intermediate set of coefficients based on the step parameter. The beamforming controller 12 may be configured to transmit each intermediate set of coefficients to the beamforming module 10 using a control signal 13 indicative of the intermediate set. The beamforming module 10 is configured to apply at least part of the intermediate sets and then at least part of the target set of coefficients to any one of the microphone input signals 8A and 6A.

The beamforming controller 12 may be configured to determine a first intermediate set of coefficients based on the first set and the target set of coefficients. The beamforming controller 12 is configured to control the beamforming module 10 to apply at least part of the first intermediate set and eventually the target set of coefficients in the beamforming module 10, e.g. by transmitting a control signal 13 to the beamforming module 10. The beamforming controller 12 is configured to control the beamforming module 10 to apply at least part of the target set of coefficients to any one of the microphone input signals 8A and 6A.

The beamforming controller 12 is configured to transmit the target set of coefficients in a control signal 13 to the beamforming module 10.

The first intermediate set of coefficients may comprise a first primary intermediate set of coefficients and a first secondary intermediate set of coefficients. The beamforming module 10 is configured to apply the first primary intermediate set of coefficients to the first and second microphone input signals 6A 8A. The beamforming controller 14 may be configured to provide a control signal 14B indicative of the first intermediate set to the transceiver module 4, which is configured to send the control signal 14B to the contralateral signal. The control signal 14B may comprise the first intermediate set of coefficients. The contralateral hearing device is configured to apply the first secondary intermediate set of coefficients to the contralateral signal.

Figure 2:
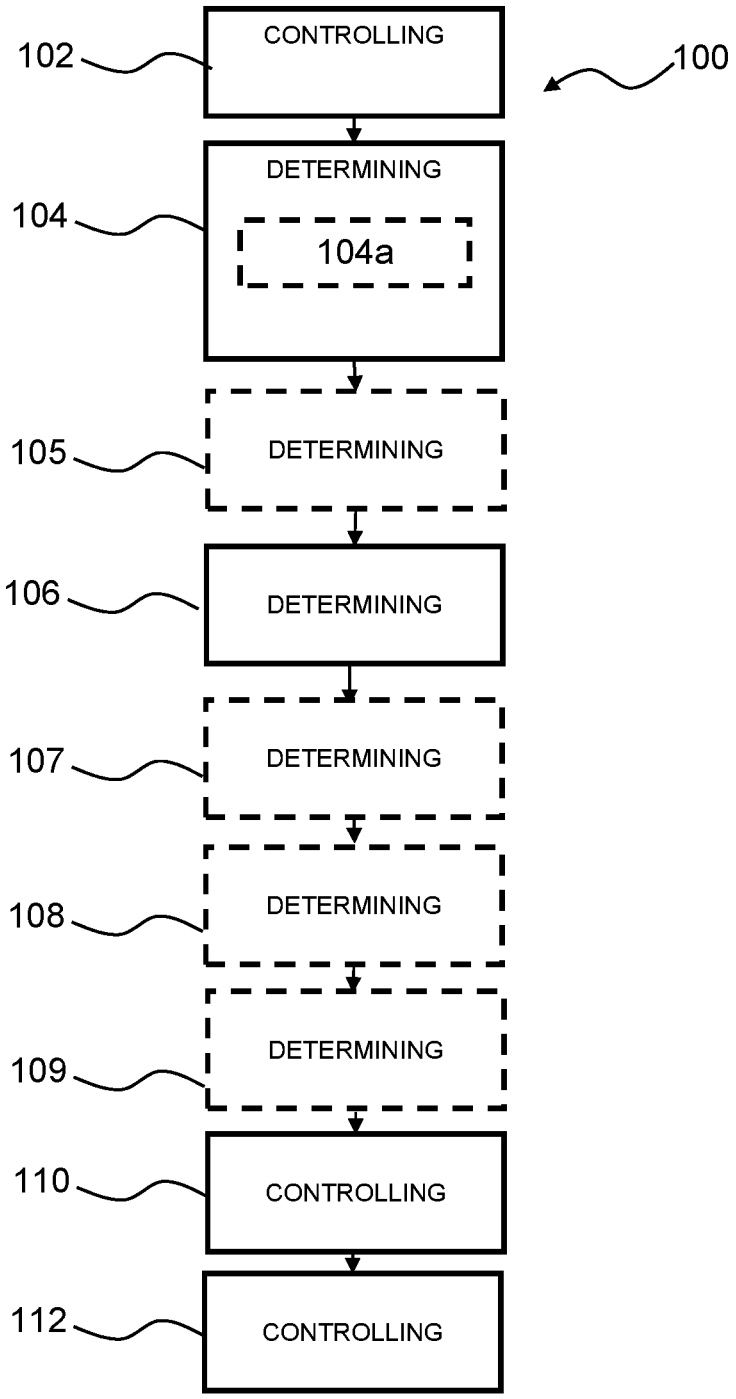
FIG. 2 is a flow diagram of an exemplary method according to the disclosure.

FIG. 2 shows a flow diagram of an exemplary method of controlling beamforming in a hearing device according to the disclosure. The method 100 is performing in the hearing device. The method 100 comprises controlling 102 a beamforming scheme to apply at least part of a first set of coefficients to a microphone input signal and a contralateral signal.

The method 100 comprises determining 104 a target set of coefficients. In one or more exemplary methods, determining 104 the target set of coefficients is performed based on an acoustic environment parameter. In one or more exemplary methods, determining 104 the target set of coefficients comprises optimizing 104*a* a cost function of the first set of coefficients based on a statistical expectation.

The method 100 comprises determining 106 a first intermediate set of coefficients based on the first set and the target set of coefficients.

The method 100 comprises controlling 110 the beamforming scheme to apply at least part of the first intermediate set of coefficients to the microphone input signal and the contralateral signal. Controlling 110 the beamforming scheme to apply at least part of the first intermediate set of coefficients to the microphone input signal may comprise transmitting a control signal including the first intermediate set of coefficients to a beamforming module of the hearing device and to a contralateral hearing device. The first intermediate set of coefficients may comprise a first primary intermediate set of coefficients and a first secondary intermediate set of coefficients. The beamforming module is configured to apply the first primary intermediate set of coefficients to the microphone input signal and the contralateral hearing device is configured to apply the first secondary intermediate set of coefficients to the contralateral signal.

In one or more exemplary methods, the method 100 comprises determining 105 whether the target set of coefficients satisfies a flexible control criterion. The acts of determining 106 a first intermediate set of coefficients based on the first set and the target set of coefficients and of controlling 110 the beamforming module to apply at least part of the first intermediate set of coefficients in the beamforming module may be performed when the target set of coefficients satisfies the flexible control criterion.

The method 100 comprises controlling 112 the beamforming scheme to apply at least part of the target set of coefficients to the microphone input signal and the contralateral signal. Controlling 112 the beamforming scheme to apply the target set of coefficients to the microphone input signal and the contralateral signal may comprise transmitting a control signal including the target set of coefficients to a beamforming module of the hearing device and to a contralateral hearing device. The target set of coefficients may comprise a target primary set of coefficients and a target secondary set of coefficients. The beamforming module is configured to apply the target primary set of coefficients to the microphone input signal and the contralateral hearing device is configured to apply the target secondary set of coefficients to the contralateral signal.

In one or more exemplary methods, determining 104 the target set of coefficients is performed based on an acoustic environment parameter.

In one or more exemplary methods, determining 104 the target set of coefficients comprises optimizing 104*a* a cost function of the first set of coefficients based on a statistical expectation.

In one or more exemplary methods, the method 100 comprises determining 107 a number of intermediate sets of coefficients, such as based on the step parameter.

The method 100 may comprise determining 108 one or more coefficients for each intermediate set of coefficients; and sequentially controlling 109 the beamforming module to apply at least part of the intermediate sets of coefficients before applying the target set of coefficients. The intermediate set of coefficients may comprise a primary intermediate set of coefficients and a secondary intermediate set of coefficients. The beamforming module is configured to apply the primary intermediate set of coefficients to the microphone input signal and the contralateral hearing device is configured to apply the secondary intermediate set of coefficients to the contralateral signal.

As used in this specification, the term "processing unit" may refer to software, hardware, or a combination of the foregoing. Also, the term "processing unit" may be a processor, an integrated circuit, a part of a processor, or a part of an integrated circuit. In some embodiments, the processing unit includes at least some hardware. Also, in some embodiments, the processing unit 16 may be a part of a processor that also implements the beamforming module 10 and/or the beamforming controller 12. In other embodiments, the processing unit 16 may be a processor that is coupled to the beamforming module 10 and/or the beamforming controller 12.

Similarly, as used in this specification, the term "module" (e.g., as in "beamforming module") may refer to software, hardware, or a combination of the foregoing. Also, the term "module" may be a processor, an integrated circuit, a part of a processor, or a part of an integrated circuit. In some embodiments, a module includes at least some hardware.

Although features have been shown and described, it will be understood that they are not intended to limit the claimed invention, and it will be made obvious to those skilled in the art that various changes and modifications may be made without departing from the spirit and scope of the claimed invention. The specification and drawings are, accordingly to be regarded in an illustrative rather than restrictive sense. The claimed invention is intended to cover all alternatives, modifications, and equivalents.

LIST OF REFERENCES

2 hearing device
4 transceiver module
4A antenna
4B radio transceiver
5 contralateral signal
5 contralateral beamform signal
6 first microphone
6A first microphone input signal
8 second microphone
8A second microphone input signal
10 beamforming module
10A first beamformed input signal
12 beamforming controller
13 control signal to the beamforming module
14A control signal to the processing unit
14B control signal to the transceiver module for the contralateral hearing device
16 processing unit
16A electrical output signal
18 receiver
100 method of controlling beamforming in a hearing device
102 controlling a beamforming scheme to apply at least part of a first set of coefficients to a microphone input signal and a contralateral signal
104 determining a target set of coefficients
104*a* optimizing a cost function of the first set of coefficients based on a statistical expectation
105 determining whether the target set of coefficients satisfies a flexible control criterion
106 determining a first intermediate set of coefficients based on the first set and the target set of coefficients
107 determining a number of intermediate sets of coefficients
108 determining one or more coefficients for each intermediate set of coefficients
109 controlling the beamforming module to apply at least part of the intermediate sets of coefficients before applying the target set of coefficients
110 controlling the beamforming scheme to apply at least part of the first intermediate set of coefficients to the microphone input signal and the contralateral signal
112 controlling the beamforming scheme to apply at least part of the target set of coefficients to the microphone input signal and the contralateral signal

The invention claimed is:

1. A hearing device of a binaural hearing system comprising the hearing device and a contralateral hearing device, the hearing device comprising:

a transceiver module for communication with the contralateral hearing device of the binaural system, the transceiver module configured for provision of a contralateral signal received from the contralateral hearing device;

a set of microphones comprising a first microphone and a second microphone for provision of a first microphone input signal and a second microphone input signal, respectively;

a beamforming module connected to the first microphone and the second microphone for processing the first microphone input signal, the second microphone input signal, and the contralateral signal, wherein the beamforming module is configured to provide a first beamformed input signal;

a processing unit configured to provide an electrical output signal based on the first beamformed input signal;

a receiver configured to provide an audio output signal based on the electrical output signal; and a beamforming controller connected to the beamforming module and the transceiver module;

wherein the beamforming controller is configured to:

control the beamforming module to apply at least a part of a first set of coefficients;

determine a target set of coefficients for the beamforming module;

determine a first intermediate set of coefficients based on one or more coefficients in the first set of coefficients, and based on one or more coefficients in the target set of coefficients;

control the beamforming module to apply at least a part of the first intermediate set of coefficients; and control the beamforming module to apply at least a part of the target set of coefficients.

2. The hearing device according to claim 1, wherein the first intermediate set of coefficients is normalized.

3. The hearing device according to claim 1, wherein the beamforming controller is configured to determine whether the target set of coefficient satisfies a flexible control criterion; and wherein the beamforming controller is configured to determine the first intermediate set of coefficients, and to control the beamforming module to apply the at least a part of the first intermediate set of coefficients if the target set of coefficient satisfies the flexible control criterion.

4. The hearing device according to claim 3, wherein the flexible control criterion is based on a perception parameter.

5. The hearing device according to claim 4, wherein the perception parameter is based on one or more user preferences.

6. The hearing device according to claim 3, wherein the flexible control criterion is based on a step parameter.

7. The hearing device according to claim 6, wherein the step parameter is selected from a range.

8. The hearing device according to claim 1, wherein the beamforming controller is configured to determine the target set of coefficients based on an acoustic environment parameter.

9. The hearing device according to claim 1, wherein the beamforming controller is configured to determine the target set of coefficients for the beamforming module by optimizing a cost function of the first set of coefficients based on a statistical expectation.

10. The hearing device according to claim 1, wherein the beamforming controller is configured to determine a second intermediate set of coefficients; and wherein the beamforming controller is configured to control the beamforming module to apply at least a part of the first and second intermediate sets of coefficients before applying the target set of coefficients.

11. A method of controlling beamforming of a hearing device, the method comprising:

controlling a beamforming scheme to apply at least a part of a first set of coefficients to a microphone input signal and to a contralateral signal;

determining a target set of coefficients;

determining a first intermediate set of coefficients based on one or more coefficients in the first set of coefficients and based on one or more coefficients in the target set of coefficients;

controlling the beamforming scheme to apply at least a part of the first intermediate set of coefficients to the microphone input signal and to the contralateral signal; and controlling the beamforming scheme to apply at least a part of the target set of coefficients to the microphone input signal and to the contralateral signal.

12. The method according to claim 11, further comprising:

determining whether the target set of coefficients satisfies a flexible control criterion;

wherein the act of determining the first intermediate set of coefficients, and the act of controlling the beamforming module to apply the at least a part of the first intermediate set of coefficients, are performed if the target set of coefficients satisfies the flexible control criterion.

13. The method according to claim 11, wherein the act of determining the target set of coefficients is performed based on an acoustic environment parameter.

14. The method according to claim 11, wherein the act of determining the target set of coefficients comprises optimizing a cost function of the first set of coefficients based on a statistical expectation.

15. The method according to claim 11, further comprising:

determining a second intermediate set of coefficients; and controlling the beamforming module to apply at least a part of the first and second intermediate sets of coefficients before applying the target set of coefficients.

* * * * *